United States Patent [19]

Gassler et al.

[11] Patent Number: 4,681,014

[45] Date of Patent: Jul. 21, 1987

[54] MISSILE AZIMUTH ALIGNMENT SYSTEM

[75] Inventors: Richard D. Gassler, Campbell; Bettadapur N. Sridhar, Cupertino, both of Calif.

[73] Assignee: The United States of America as represented by the Secretary of the Air Force, Washington, D.C.

[21] Appl. No.: 888,608

[22] Filed: Jul. 23, 1986

[51] Int. Cl.[4] ..... F41F 3/04

[52] U.S. Cl. ..... 89/1.816; 89/1.819

[58] Field of Search ..... 89/1.816, 1.817, 1.818, 89/1.819, 1.8, 1.810, 1.809, 1.1; 308/3 R, 3.9

[56] References Cited

U.S. PATENT DOCUMENTS

| | | | |
|---|---|---|---|
| 2,448,343 | 8/1948 | Zandmer | 102/517 |
| 2,998,754 | 9/1961 | Bialy | 89/1.816 |
| 3,088,374 | 5/1963 | Guyant et al. | 89/1.817 X |
| 3,135,162 | 6/1964 | Kamolian | 89/1.810 |
| 3,499,364 | 3/1970 | D'Ooge | 89/1.817 X |
| 3,899,953 | 8/1975 | Labruyere | 89/1.819 |
| 4,155,286 | 5/1979 | Mihm | 89/1.819 |
| 4,392,411 | 7/1983 | Minkler | 89/1.819 |
| 4,415,304 | 11/1983 | Tripoli et al. | 89/1.816 X |
| 4,492,143 | 1/1985 | Ruhle | 89/1.816 |

*Primary Examiner*—David H. Brown

*Attorney, Agent, or Firm*—Richard J. Donahue; Donald J. Singer

[57] ABSTRACT

A continuous alignment system for preventing rotation of a missile during on-loading in a launching tube, while permitting a controlled translation of the missile in the launching tube when subjected to external seismic shocks.

7 Claims, 4 Drawing Figures

MISSILE AZIMUTH ALIGNMENT SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to tube-launched missiles and more particularly to a system for establishing and maintaining a desired azimuthal alignment of the missile within its launch tube while permitting translation of the missile on its support assembly under shock loads.

In a copending patent application by R. D. Gassler entitled "Missile Longitudinal Support Assembly", and assigned Ser. No. 762,888, there is disclosed an improved longitudinal support assembly for a tube launched missile. This missile support assembly provides axial support to the missile while permitting a certain amount of translation of the missile within its launching tube, also called a canister or silo, under seismic shock conditions. This is a highly desireable feature. The support assembly basically comprises a plurality of axial support rods positioned between a pair of gimbaled rings, the top ring being attached to the skirt of the missile and the bottom ring being attached to the air elevator for the missile.

During on-loading of the missile and the attached support assembly into the launching tube, it has been observed that the missile has a tendency to rotate, causing a misalignment of the umbilical plug thereon with respect to the cutout for the plug in the wall of the launching tube or canister. The exact cause of this rotational movement, often called either clocking or rifling, is not known with certainty, but is probably due to any one or a combination of cable twist, center of gravity offset, canister-missile geometry, pad shape, or launch seal compression. Each of these possible causes of rotational movement of the missile is discussed briefly in the following paragraphs.

the cable used to lower a large missile into its launching tube, for example, is often a twisted cable. The missile is first freely suspended just above the tube to permit missile rotation and to eliminate any cable twist. A relaxed condition, i.e. no cable torque, is established before the missile is inserted into the launching tube. As the missile is on-loaded, the vertical force or tension in the cable changes due to the missile weight being taken up by the launch pad friction. This causes a winding or unwinding of the cable, depending on the way the cable strands are wound, and brings about a torque from the cable which although slight, may be sufficient to clock the missile during its further insertion into the tube. A cross-wound cable would tend to act in a similar manner, although the resulting torque would be much less for this type of cable.

In some instances, the missile center of gravity may be offset radially from the theoretical missile center line. This offset may cause the missile to align to a lower potential energy state with resultant clocking of the missile.

The geometry and tolerances of the launching tube and missile can also bring about clocking during on-loading. Neither the missile nor the launching tube is perfectly round, or straight. The pressure exerted on the pads often placed between the missile and the launching tube wall will tend to seek a lower state of potential energy or total pad pressure. Therefore, the missile may rotate to minimize this potential energy. These geometrical differences can be within normal fabrication tolerances and yet have an appreciable effect on azimuth location or clocking.

The shape of each pad may be such that it offsets in a particular direction upon compression. While the pad rows are sometimes installed with this pad offset tendency aligned oppositely in alternate rows, no pad row is compressed an equal amount because of missile and launch tube geometrical irregularities, and this opposite offset tendency of alternate rows is never completely balanced. This may also cause the missile to clock within the launch tube during on-loading.

Several concepts have been proposed either to correct for misalignment after the missile has clocked during its on-loading, or to prevent its clocking during its on-loading. In one concept, the missile is loaded into the launch tube using an emplacer which holds the missile in the correct azimuth position until the first pad row is inserted into the canister. At this point, the air elevator is used to lower the missile. The missile is allowed to clock but is corrected by each set of air elevator stops. The air elevator stops engage guide rails mounted on an alignment cylinder attached to the missile support assembly. The bottom set of stops guide the missile into the final azimuth position. This method has the disadvantage of high loads on the guide rails and air elevator stops.

Another on-loading concept involves the use of steerable wheels mounted on the missile support assembly and bearing against the inner wall of the launching tube. Azimuth alignment is accomplished by steering the wheels as the missile is lowered into the launching tube. The wheels apply a force on the inner wall of the launch tube to cause the missile to rotate back to the desired azimuth location. This concept requires apparatus for remotely controlling the operation of the steering of the wheels, resulting in added complexity, cost and decreasing the reliability of the system.

In U.S. Pat. No. 3,088,374 issued to J. L. Guyant et al on May 7, 1963, there is disclosed an inching and centering system for rotating a missile in order that access doors in the tube will align with similar openings on the missile. This system requires a complex and expensive hydraulic mechanism positioned near the base of the missile.

The use of a track guide, per se, on the internal wall of a launch tube to maintain alignment of a missile therein is known, and a version thereof is disclosed in U.S. Pat. No. 2,998,754 issued to K. J. Bialy on Sept. 5, 1961. A spring loaded ball bearing assembly attached to the fins of a missile cooperates with grooves in the wall of the launching tube. It is stated in this patent that the use of bearings which roll in the guideways reduces the force necessary to launch the missile since there is less friction and inertia than with sliding launching shoes of prior devices.

While such prior art mechanisms have contacting members between a missile and its launching tube to either prevent, or in some instances impart an axial rotation to a missile during its launching, or to reduce frictional forces during launching, and while such mechanisms might prevent rifling of the missile during its insertion in the launching tube, they all have various drawbacks, such as complexity, poor reliability, large physical size, high cost, etc., which make them unsuitable in certain applications. One feature which they all lack is that they do not permit a controlled movement of the missile in all planes after the missile has been loaded in the container. As mentioned earlier with regard to the copending application of R. D. Gassler, it is desireable to provide a missile support which permits a limited amount of axial and radial translation of the missile within the launch tube to protect the missile when it is subjected to seismic forces or shocks caused by earthquakes or nearby nuclear explosions.

OBJECTS AND SUMMARY OF THE INVENTION

It is therefore an object of the present invention to provide an improved missile azimuth alignment system.

It is a further object of the present invention to provide a missile azimuth alignment system having a high degree of reliability and capable of insertion and operation in a limited space envelope within a missile launching tube.

It is a further object of the invention to provide a missile azimuth alignment system which reduces on-loading time and eliminates operator influence upon the final alignment of the missile in its launch tube.

It is a further object of the present invention to provide a missile azimuth alignment system which permits the missile support assembly to translate in any direction when positioned within the launching tube and subjected to external seismic forces.

It is a further object of the present invention to provide a missile azimuth alignment system which prevents binding of the system during on-loading of the missile into its launch tube.

It is a further object of the present invention to provide a missile azimuth alignment system that does not adversely affect the performance of either the launch seals or the air elevator seals.

It is a further object of the present invention to provide a missile azimuth alignment system that facilitates the initial engagement of the guide track and slider elements of the alignment system.

According to this invention, a missile azimuth alignment system includes a longitudinally extending track attached to the inner wall of the launching tube and having a T-slot therein. A track follower block has an integral T-shaped male shoe which engages and slides in the T-slot. A pivot follower block pivotally engages the track follower block and also has a T-shaped male shoe engaging the T-slot in the track. A missile longitudinal support assembly (LSA) follower block telescopically engages the pivot block, and a coil compression spring between the pivot follower block and the LSA follower block allows limited radial movement between the two. The LSA follower block is attached to the missile support assembly which is attached to the skirt of the missile and supports the missile. The rails on the end of the track are progressively separated to assume a V-shape and permit the pivot follower block to pivot when the missile has bottomed in its launching tube. The missile can now freely translate on its support assembly and thereby withstand external shocks.

BRIEF DESCRIPTION OF THE DRAWINGS

Additional objectives, features and advantages of the present invention will become apparent from the following detailed description when read in conjunction with the accompanying drawings, wherein.

DETAILED DESCRIPTION OF THE PREFERRED EMBODIMENT

Figure 1:
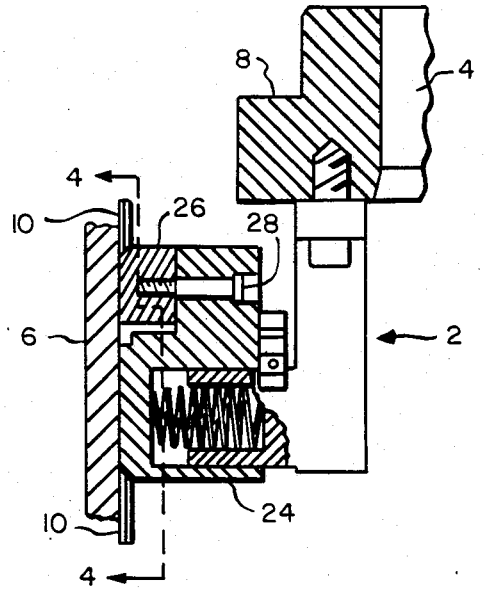
FIG. 1 is a side view of the missile azimuth alignment system of the present invention.

Referring now to the drawings, FIG. 1 illustrates the preferred embodiment of the missile azimuth alignment system 2 as it is affixed between a missile longitudinal support ring 4 and the inner wall of a missile launching tube 6. Missile support ring 4 is a part of the missile support assembly and will be seen to have a flange 8 for mating with the skirt of a missile.

Figure 2:
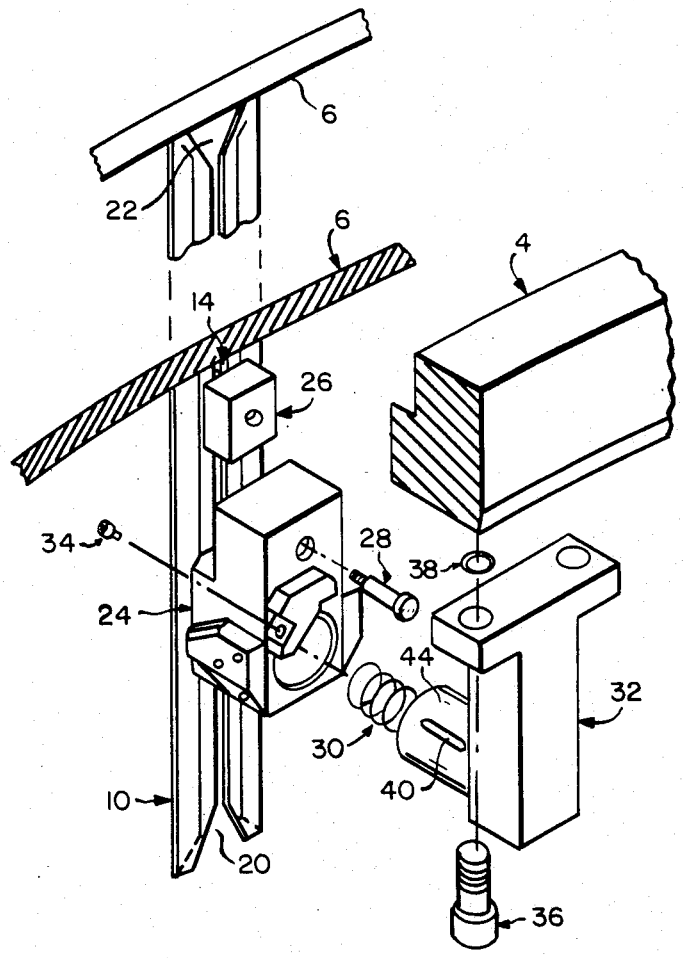
FIG. 2 is an expanded view of the missile azimuth alignment system of the present invention.

Some areas of missile alignment system 2 have been removed in the drawing to expose the inner parts of the system and facilitate an understanding of the operation thereof. In addition, an exploded view of the alignment system is provided in FIG. 2 of the drawings.

Figure 3:
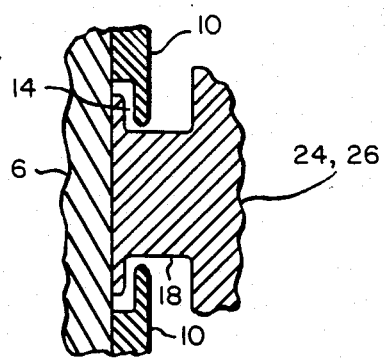
FIG. 3 is an enlarged cross-sectional top view of the guide rails and T-shaped shoe portion of either the track follower block or the pivot follower block 24 of the slider mechanism of the present invention.

The guide track 10 of the alignment system consists of two rails of symmetrical shapes forming a T-slot 14 that keeps each of the two identical T-shaped shoes 18 of the slider mechanism captive. FIG. 3 provides an enlarged cross-sectional view of the rails 10, T-slot 14 and T-shaped shoe 18 of either the pivot follower block 24 or the track follower block 26 of the slider mechanism.

Track 10 is secured to the inside of launching tube 6 and runs from the top of tube 6 to just below the support ring 4. The lower end 20 of track 10 and also the upper end 22 are tapered to provide a smooth contour to prevent tearing of the launch and/or elevator seals. Track 10 is preferrably made of 0.125 inch thick high strength steel and is fastened to the launch tube 10 with about 250 high strength low profile 100 degree flat head screws. The sliding surfaces of the tracks are coated with baked-on molybdenum disulphide to minimize galling and reduce friction.

The T-slot 14 in track 10 is enlarged at lower end 20 of track 10 and V-shaped to permit freedom of movement of the support assembly 2 in all planes after the missile has been lowered into launch tube 6, as will be discussed later. Slot 14 is similarly configured at the upper end 22 of track 10 to facilitate initial engagement of the missile and launching tube.

The slider mechanism portion of the alignment system 2 comprises a pivot follower block 24, a track follower block 26, a shoulder screw 28, which functions as an upper pivot, a compression spring 30, a missile support ring follower block 32, a shear pin 34, as well as cap screws 36 and o-rings 38, only one of each being shown.

Spring 30 serves to load the track follower block 26 and pivot follower block 24 against the inner wall of launch tube 6. The telescoping arrangement of the lower pivot allows for radial displacement during operation of the air elevator for the missile. Missile support ring follower block 32 is bolted to the underside of the missile support ring 4 by cap screws 36.

During the loading operation, both the pivot follower block 24 and the track follower block 26 engage the T-slot 14 in track 10 via their individual male T-flange shoes. However, in the alert position, when the missile is enclosed in the launch tube, only the track follower block 26 has its T-flange shoe engaged in and retained by the T-slot of track 10. The T-flange shoe of pivot follower block 24 is now adjacent the enlarged V-shaped lower end 20 of track 10 and is free to pivot. This arrangement allows unencumbered movement of the missile and its support ring 4 during torsional shock loading of the missile by external forces.

Shear pin 34 is pressed into pivot follower block 24 and engages a slot 40 formed in the pivoting cylinder 44 of missile support ring follower block 32. Slot 40 has sufficient clearance to permit about a 4 degree rotation of support ring follower block 32. This 4 degree rotation capability permits engagement without binding of the two T-flange shoe slider elements into the T-slot of track 10 during on-loading of the missile, without excessive loading of the sliders or track 10.

During a shock loading of the missile, the shear pin 34 will break and is captured in slot 40. This will now permit relative motion between track follower block 26 and pivot follower block 24 about their respective pivots, formed by shoulder screw 28 and cylinder 44. The missile and its longitudinal support assembly are then free to move in all planes in the launching tube.

Figure 4:
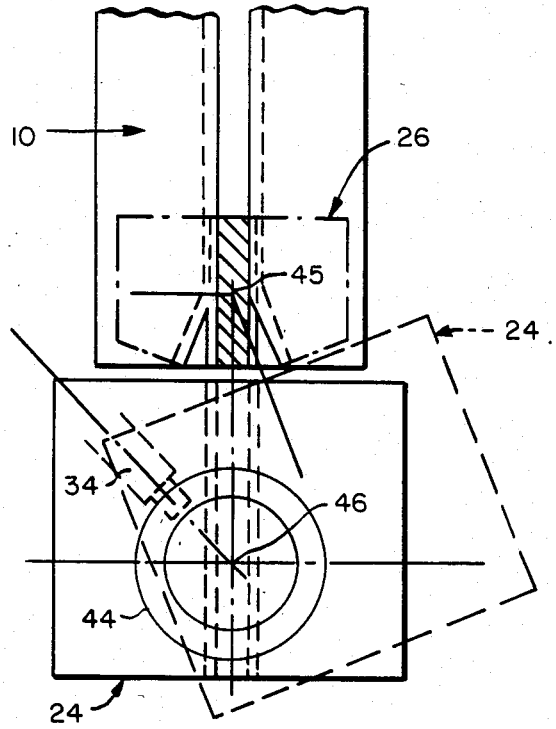
FIG. 4 is a sectional view taken through the line 4—4 of FIG. 1, illustrating the normal and shock positions of the missile azimuth alignment system of the present invention.

FIG. 4 is a cross-section of the alignment system 2 as viewed in the plane formed through the line 4—4 of FIG. 1. This drawing has been purposely simplified, including the elimination of section lines, in order to best illustrate the upper and lower pivot points 45 and 46 respectively of the system, and to also show the permitted excursion of pivot follower block 24 under shock conditions. The location of shear pin 34 on cylinder 44 is also shown.

Although the invention has been described with reference to a particular embodiment, it will be understood to those skilled in the art that the invention is capable of a variety of alternative embodiments within the spirit and scope of the appended claims.

What is claimed is:

1. A missile azimuth alignment system for preventing axial rotation of a missile while being loaded into a launching tube and for thereafter permitting shock-induced translations of the missile on a resilient missile support assembly comprising:

an azimuth alignment track having a first end and a second end and comprising a pair of parallel metallic rails having a slot formed therebetween;

a track follower block having a first slider shoe retainable in said slot of said track;

a pivot follower block pivotally affixed to said track follower block and having a second slider shoe retainable in said slot of said track; and a missile support assembly follower block pivotally affixed to said pivot follower block;

said slot in said track being widened at said second end thereof to release said second slider shoe from said track and permit translation of said missile support assembly follower block with respect to said track.

2. A missile azimuth alignment system as defined in claim 1 wherein said slot formed in said track is a T-shaped slot and wherein said first and said second slider shoes are each T-flange shaped shoes.

3. A missile azimuth alignment system as defined in claim 2 wherein said pivot follower block is pivotally affixed to said track follower block by a shoulder screw extending through said pivot follower block into said track follower block.

4. A missile azimuth alignment system as defined in claim 3 wherein said missile support assembly follower block is pivotally affixed to said pivot follower block by means of a cylindrical projection extending from said missile support assembly follower block into a cylindrical cavity formed in said pivot follower block.

5. A missile azimuth alignment system as defined in claim 4 and further comprising:

a spring contained within said cylindrical projection and bearing against said pivot follower block.

6. A missile azimuth alignment system as defined in claim 5 and further comprising:

an axial slot formed in the wall of said cylindrical projection; and a shear pin protruding through said pivot follower block into said axial slot in said wall of said cylindrical projection.

7. A missile azimuth alignment system as defined in claim 6 wherein said slot in said track is widened at said first end thereof to facilitate the initial engagement of said first and said second slider shoes in said slot in said track.

* * * * *

UNITED STATES PATENT AND TRADEMARK OFFICE

CERTIFICATE OF CORRECTION

PATENT NO. : 4,681,014

DATED : July 21, 1987

INVENTOR(S) : Richard D. Gassler et al

It is certified that error appears in the above-identified patent and that said Letters Patent is hereby corrected as shown below:

In column 1, on line 43, before the word "cable", the word "the" should read --The--.

In column 4, on line 7, after the word "block" (first occurrence), add the reference numeral --26--.

In column 4, on line 49, before the word "V-shaped", add the word --is--.

Signed and Sealed this

Twenty-second Day of December, 1987

*Attest:*

*Attesting Officer*

DONALD J QUIGG

*Commissioner of Patents and Trademarks*